US008235390B1

(12) United States Patent
Spikes

(10) Patent No.: US 8,235,390 B1
(45) Date of Patent: Aug. 7, 2012

(54) AUTOMATED TARGET ASSEMBLY

(76) Inventor: Larry Spikes, Marshall, TX (US)

( * ) Notice: Subject to any disclaimer, the term of this patent is extended or adjusted under 35 U.S.C. 154(b) by 247 days.

(21) Appl. No.: 12/803,007

(22) Filed: Jun. 17, 2010

(51) Int. Cl.
*F41J 5/14* (2006.01)
*F41J 1/10* (2006.01)

(52) U.S. Cl. ..... 273/406; 273/392

(58) Field of Classification Search ..... 273/390–392, 273/403–410
See application file for complete search history.

(56) References Cited

U.S. PATENT DOCUMENTS 631,175 A * 8/1899 Parnall ..... 273/406
2,104,171 A * 1/1938 Schwerin ..... 273/406
3,064,976 A * 11/1962 Kuhn ..... 273/369
4,807,888 A * 2/1989 Pidde et al. ..... 273/392
4,979,752 A * 12/1990 Fosseen ..... 273/392
6,325,376 B1 * 12/2001 Elliott et al. ..... 273/406
7,201,376 B2 * 4/2007 Kuosa ..... 273/392
7,950,666 B2 * 5/2011 Stincelli et al. ..... 273/406
8,006,981 B2 * 8/2011 Gibson ..... 273/359
2006/0290064 A1 * 12/2006 Hagar ..... 273/392

* cited by examiner

*Primary Examiner* — Mark Graham
(74) *Attorney, Agent, or Firm* — R. Keith Harrison

(57) ABSTRACT

An automated target assembly includes a target post, a target carriage carried by the target post, a target having a switch activation flange pivotally carried by the target carriage, a target linkage assembly engaging the target carriage, a power supply, a drive motor connected to the power supply and drivingly engaging the target linkage assembly and a target switch connected to the power supply and the drive motor within a travel path of the switch activation flange.

18 Claims, 9 Drawing Sheets

AUTOMATED TARGET ASSEMBLY

FIELD

The disclosure generally relates to targets for firearms. More particularly, the disclosure relates to an automated target assembly having a target which assumes a falling motion upon completion of a successful shooting attempt and then automatically assumes a pre-struck position for a second shooting attempt.

BACKGROUND

A variety of targets are known in the art for practicing and enhancing accuracy in the aiming and shooting of a firearm. Simple targets include glass bottles and metal cans which are placed on a fence or other support and which the shooter of the firearm attempts to strike by aiming the firearm at the target from a distance and then firing a projectile from the firearm toward the target. A more complex type of target includes a swinging steel plate which is pivotally attached to a free-standing frame. In the event that a shooter successfully shoots the plate, the plate swings or pivots on the frame.

In some instances, it may be desirable for a target to move in a falling motion upon completion of a successful shooting attempt. It may also be desirable for the target to then automatically assume the pre-struck position for a second shooting attempt. Therefore, an automated target assembly having a target which assumes a falling motion upon completion of a successful shooting attempt and then automatically assumes a pre-struck position for a second shooting attempt is needed.

SUMMARY

The disclosure is generally directed to an automated target assembly. An illustrative embodiment of the automated target assembly includes a target post, a target carriage carried by the target post, a target having a switch activation flange pivotally carried by the target carriage, a target linkage assembly engaging the target carriage, a power supply, a drive motor connected to the power supply and drivingly engaging the target linkage assembly and a target switch connected to the power supply and the drive motor within a travel path of the switch activation flange.

In some embodiments, the automated target assembly may include an assembly housing having a housing bottom and a housing wall defining a housing interior; a target post provided in the housing interior and having a lower end at the housing bottom and an upper end opposite the lower end; a target carriage carried by the target post; a target having a switch activation flange pivotally carried by the target carriage; a target linkage assembly engaging the target carriage; a power supply; a drive motor connected to the power supply and drivingly engaging the target linkage assembly; and a target switch connected to the power supply and the drive motor and disposed in general proximity to the upper end of the target post within a travel path of the switch activation flange.

In some embodiments, the automated target assembly may include an assembly housing having a housing bottom and a housing wall defining a housing interior; a battery compartment slot provided in the housing wall; a battery compartment provided in the housing interior and communicating with the battery compartment slot; a switch compartment slot provided in the housing wall; a switch compartment provided in the housing interior and communicating with the switch compartment slot; a switch platform carried by the housing wall in the housing interior; a main switch connected to the battery and carried by the switch platform in the switch compartment; a target post provided in the housing interior and having a lower end at the housing bottom and an upper end opposite the lower end; a target carriage carried by the target post; a target having a switch activation flange pivotally carried by the target carriage; a target switch connected to the main switch and carried by the switch platform in general proximity to the upper end of the target post within a travel path of the switch activation flange; a target linkage assembly engaging the target carriage; and a drive motor connected to the target switch and the battery and drivingly engaging the target linkage assembly.

BRIEF DESCRIPTION OF THE DRAWINGS

The disclosure will now be made, by way of example, with reference to the accompanying drawings, in which.

DETAILED DESCRIPTION

The following detailed description is merely exemplary in nature and is not intended to limit the described embodiments or the application and uses of the described embodiments. As used herein, the word "exemplary" or "illustrative" means "serving as an example, instance, or illustration." Any implementation described herein as "exemplary" or "illustrative" is not necessarily to be construed as preferred or advantageous over other implementations. All of the implementations described below are exemplary implementations provided to enable persons skilled in the art to practice the disclosure and are not intended to limit the scope of the appended claims. Furthermore, there is no intention to be bound by any expressed or implied theory presented in the preceding technical field, background, brief summary or the following detailed description. As used herein, relative terms such as "upper" and "lower" are not to be construed in a limiting sense but are used for purposes of illustration and description only.

Figure 1:
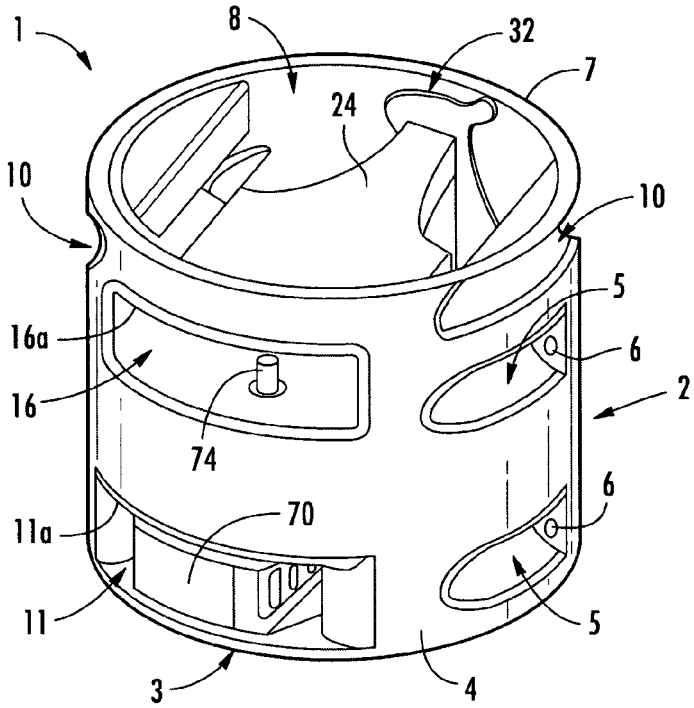
FIG. 1 is a rear perspective view of an illustrative embodiment of the automated target assembly.
Figure 2:
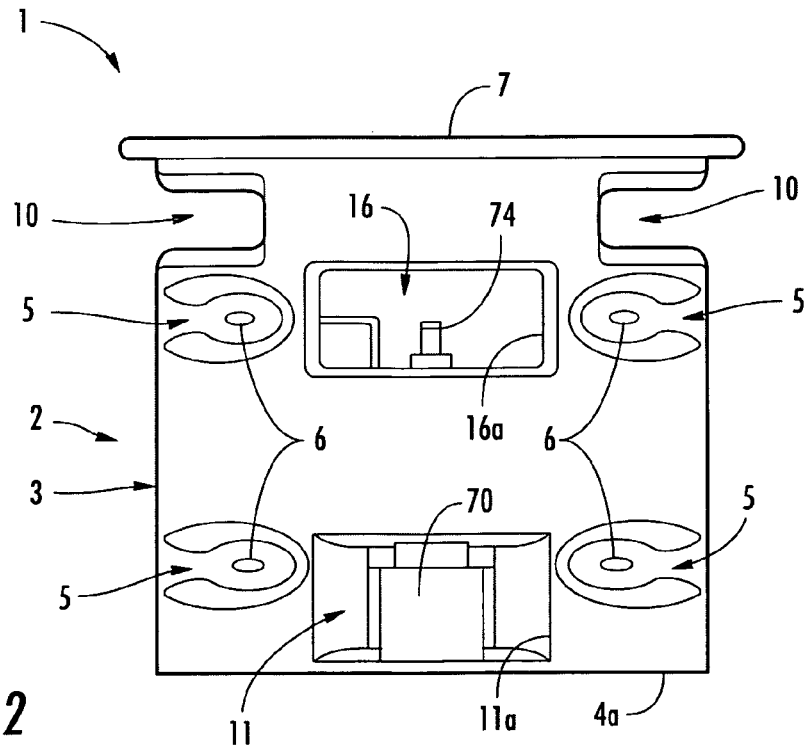
FIG. 2 is a rear view of an illustrative embodiment of the automated target assembly.
Figure 3:
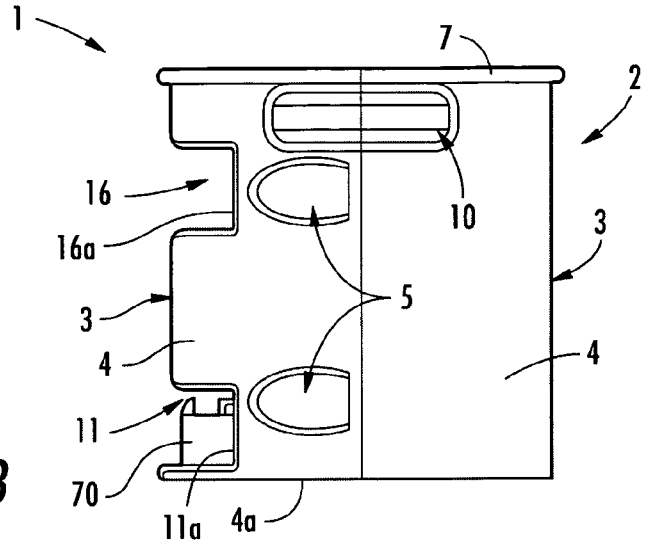
FIG. 3 is a side view of an illustrative embodiment of the automated target assembly.
Figure 4:
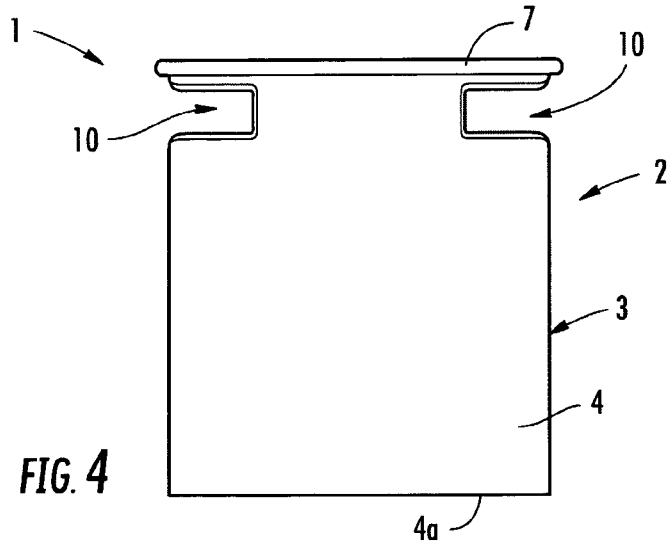
FIG. 4 is a rear view of an illustrative embodiment of the automated target assembly.
Figure 5:
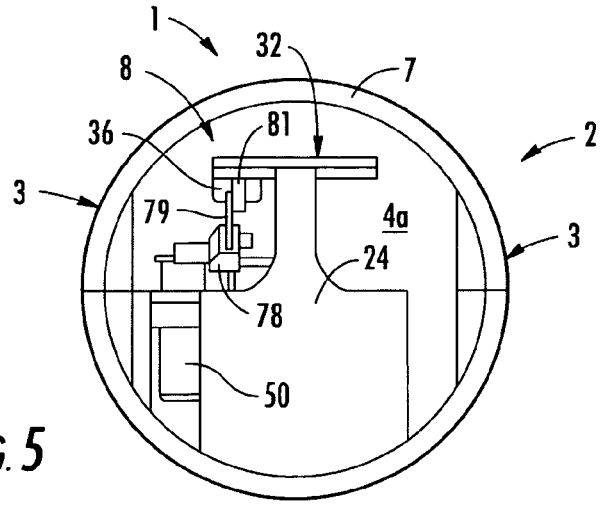
FIG. 5 is a top view of an illustrative embodiment of the automated target assembly.

Referring initially to FIGS. 1-16 of the drawings, an illustrative embodiment of the automated target assembly is generally indicated by reference numeral 1. The automated target assembly 1 may include an assembly housing 2 having a housing wall 4, a housing bottom 4*a* and a housing interior 8. In some embodiments, the housing wall 4 may be generally cylindrical, as illustrated. As illustrated in FIGS. 3 and 5, in some embodiments the assembly housing 2 may be fabricated with two matching housing sections 3. A pair of fastener cavities 5 may be provided in each side of one of the housing sections 3. A housing section fastener 6 (FIGS. 1 and 2) may extend through fastener openings (not illustrated) provided in each fastener cavity 5 and in the other housing section 3*a*, respectively, to secure the housing sections 3 to each other. In other embodiments, the housing sections 3 may be fabricated in one piece according to the knowledge of those skilled in the art. A housing lip 7 may terminate the upper edge of the housing wall 4. In some embodiments, a pair of handle indentations 10 may be provided in respective sides of the housing wall 4 beneath the housing lip 7 for carrying purposes. In other embodiments, handles (not illustrated) may be fastened, molded or otherwise attached to the exterior surface of the housing wall 4 or to any other suitable structural member of the target assembly 1. A battery compartment slot 11*a* and a switch compartment slot 16*a* may be provided in the housing wall 4 for purposes which will be hereinafter described.

Figure 6:
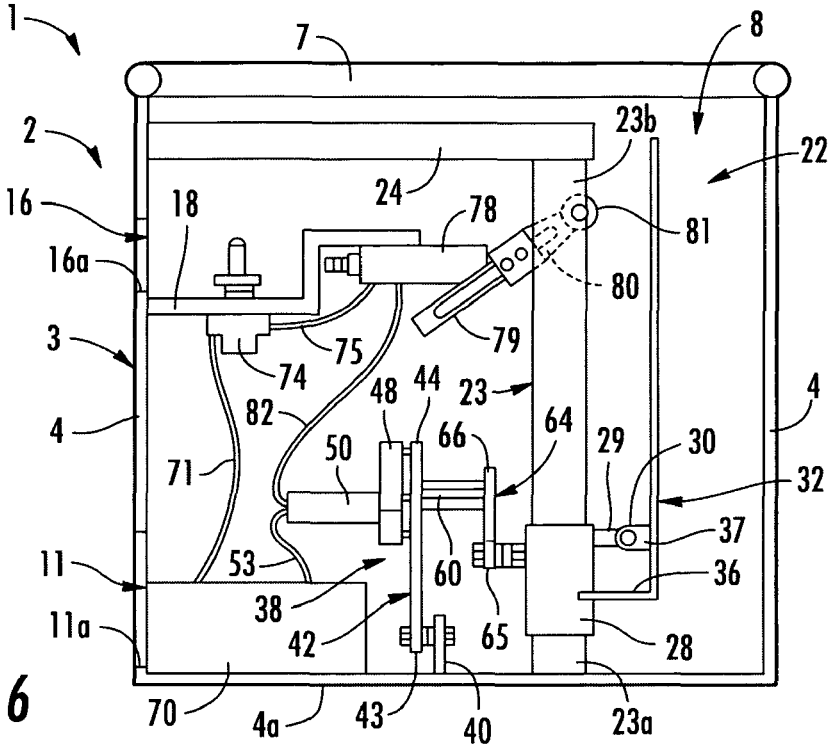
FIG. 6 is a sectional side view of an illustrative embodiment of the automated target assembly, with a target of the assembly deployed in an internal or hidden position in an assembly housing of the assembly.
Figure 7:
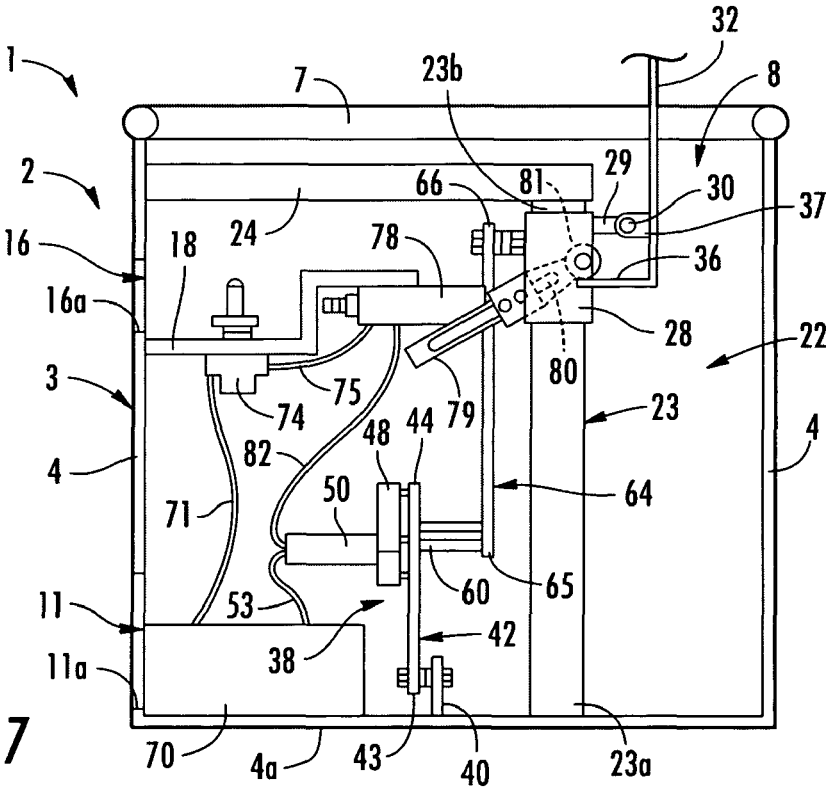
FIG. 7 is a sectional side view of an illustrative embodiment of the automated target assembly, with the target of the assembly deployed in an extended or pre-shoot position.
Figure 8:
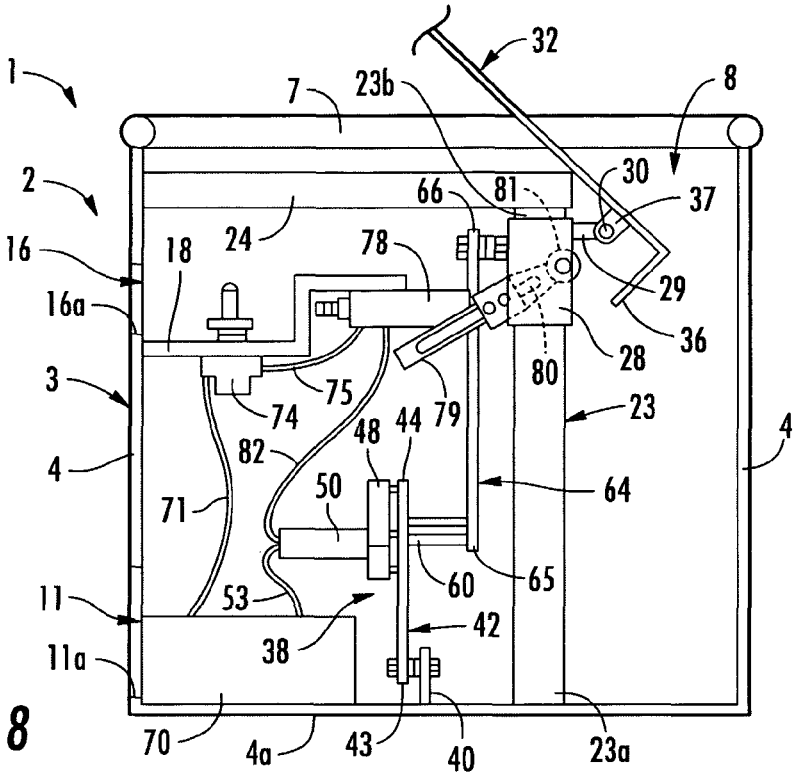
FIG. 8 is a sectional view of an illustrative embodiment of the automated target assembly, with the target of the assembly deployed in a fallen or struck position.
Figure 16:
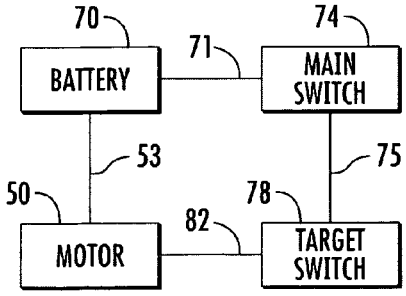
FIG. 16 is a block diagram which illustrates exemplary electrical connection of a battery, a main switch, a target switch and a motor according to an illustrative embodiment of the automated target assembly.

As illustrated in FIGS. 6-8, a battery compartment 11 may be provided in the housing interior 8 of the assembly housing 2 in communication with the battery compartment slot 11*a*. A power supply such as at least one battery 70 may be provided in the battery compartment 11. In some embodiments, the power supply for the automated target assembly 1 may include a source of alternating electrical current such as a standard household electrical outlet (not illustrated). In some of those embodiments, the battery 70 may be omitted; in other embodiments, the battery 70 may be a rechargeable battery. A switch compartment 16 may be provided in the assembly housing 2 generally above the battery compartment 11. A switch platform 18 may extend from the housing wall 4 and generally separate the switch compartment 16 from the battery compartment 11. A main switch 74 may be supported by the switch platform 18 in the switch compartment 16. The main switch 74 may be connected to the battery 70 via battery wiring 71 (FIG. 16).

A target actuator assembly 22 may be provided in the housing interior 8 of the assembly housing 2. The target actuator assembly 22 may include a generally elongated target post 23 which is upward-standing from the housing bottom 4*a* and has a lower end 23*a* at the housing bottom 4*a* and an upper end 23*b* opposite the lower end 23*a*. A target post stabilizing frame 24 may extend from the housing wall 4 into the housing interior 8 and engage the upper end 23*b* of the target post 23 for the purpose of stabilizing the target post 23 in the housing interior 8. A target carriage 28 may be slidably mounted on the target post 23.

The target actuator assembly 22 may include a target linkage assembly 38 which is adapted to raise and lower the target carriage 28 on the target post 23. In some embodiments, the target linkage assembly may include a linkage flange 40 which extends from the housing bottom 4*a* into the housing interior 8 of the assembly housing 2. A generally elongated drive linkage 42 may include a pivot end 43 which is pivotally attached to the linkage flange 40 via a pivot bolt 47 (FIG. 10) and a drive end 44 which is opposite the pivot end 43.

A linkage drive box 48 may be provided on the drive linkage 42 generally at the drive end 44. In some embodiments, multiple box fasteners 45 may attach the linkage drive box 48 to the drive linkage 42. An electric drive motor 50 may be provided on the linkage drive box 48 and connected to the battery 70 via motor wiring 53 (FIG. 16). A generally elongated target actuator linkage 64 includes a linkage attachment end 65 and a carriage attachment end 66 which is opposite the linkage attachment end 65. The linkage attachment end 65 may be drivingly engaged for rotation by the drive motor 50 according to any suitable technique which is known by those skilled in the art. As illustrated in FIG. 15, in some embodiments, a drive shaft 51 in the linkage drive box 48 may be drivingly engaged for rotation by the drive motor 50. A drive gear 52 may be drivingly engaged by the drive shaft 51 in the linkage drive box 48. An idle gear 56 in the linkage drive box 48 may be drivingly engaged by the drive gear 52. An idle gear shaft 57 may be drivingly engaged by the idle gear 56. A linkage drive shaft 60 may be drivingly engaged by the idle gear shaft 57. The linkage attachment end 65 of the target actuator linkage 64 may be connected to the linkage drive shaft 60 according to the knowledge of those skilled in the art. Accordingly, operation of the drive motor 50 transmits rotation from the drive shaft 51 through the drive gear 52, the idle gear 56, the idle gear shaft 57 and the linkage shaft 60 to the linkage attachment end 65 of the target actuator linkage 64. The linkage drive shaft 60 may extend through a linkage slot 46 (FIG. 14) which is provided in the drive linkage 42. In other embodiments, rotation may be directly or indirectly transmitted from the drive shaft 51 to the linkage drive shaft 60 according to any suitable alternative technique known by those skilled in the art.

Figure 10:
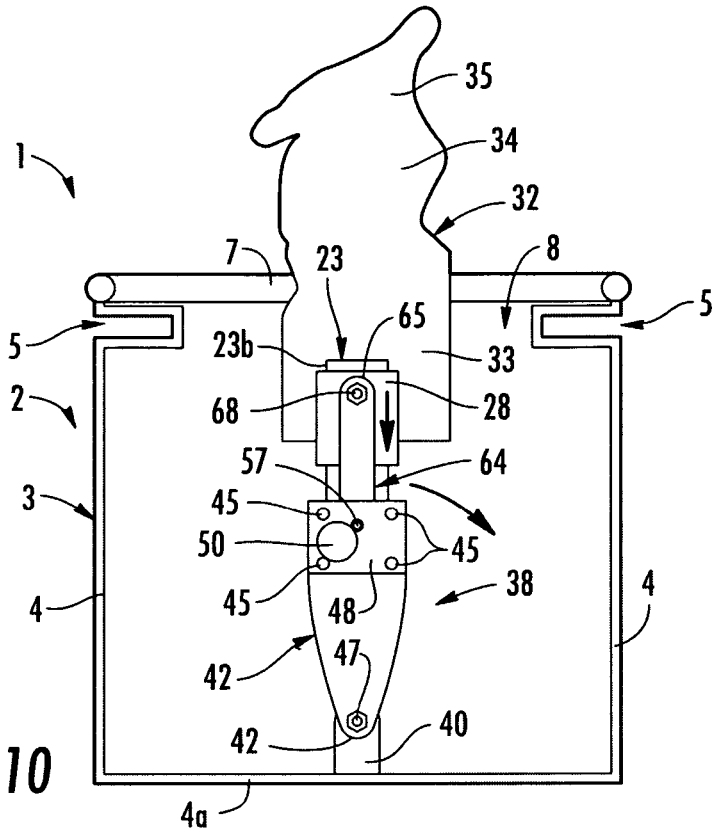
FIG. 10 is a rear sectional view of an illustrative embodiment of the automated target assembly, with the target of the assembly deployed in the extended or pre-shoot position.
Figure 11:
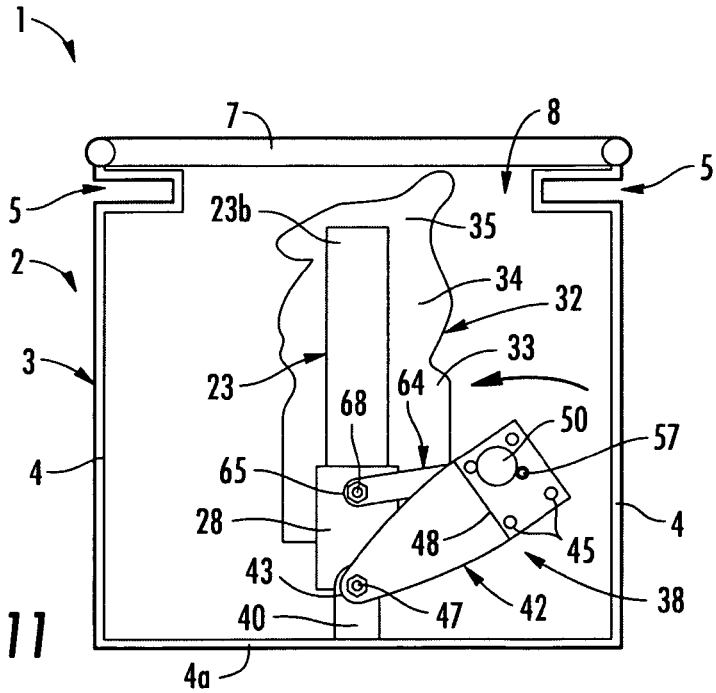
FIG. 11 is a rear sectional view of an illustrative embodiment of the automated target assembly, with the target of the assembly deployed in the internal or hidden position in the assembly housing of the assembly after a successful shooting attempt.
Figure 12:
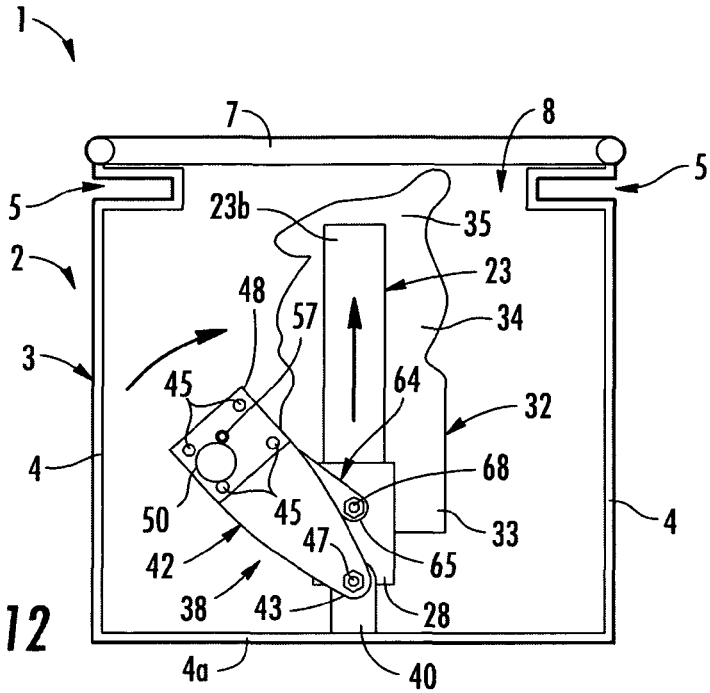
FIG. 12 is a rear sectional view of an illustrative embodiment of the automated target assembly, with the target of the assembly deployed in the internal or hidden position in the assembly housing preparatory to re-deployment in the extended position for a second shooting attempt.
Figure 13:
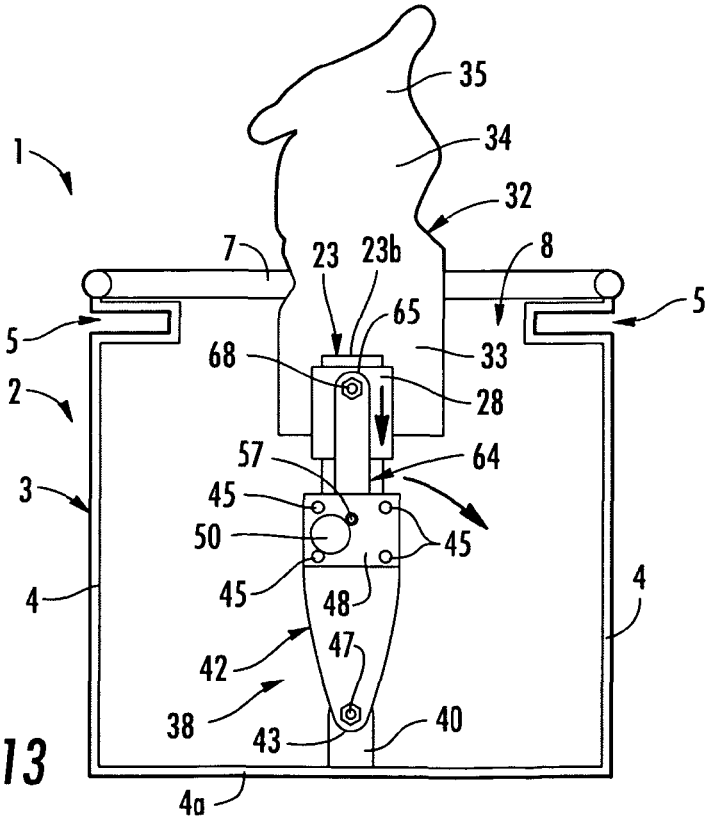
FIG. 13 is a rear sectional view of an illustrative embodiment of the automated target assembly, with the target deployed in the extended position preparatory to a second shooting attempt.
Figure 14:
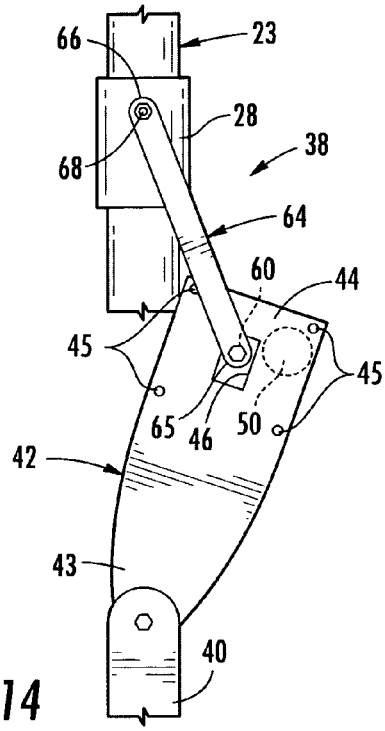
FIG. 14 is a rear view of an exemplary target linkage assembly for the target according to an illustrative embodiment of the automated target assembly.
Figure 15:
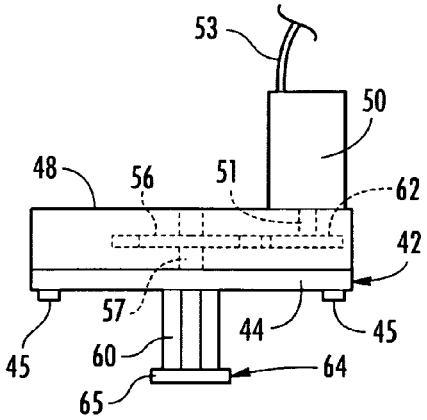
FIG. 15 is a top view of a linkage drive box and a drive linkage of the target linkage assembly, with a drive motor on the linkage drive box drivingly engaging a target actuator linkage of the target linkage assembly through a drive gear and an idle gear (illustrated in phantom) inside the linkage drive box.

As further illustrated in FIG. 14, the carriage attachment end 66 of the target actuator linkage 64 may be pivotally attached to the target carriage 28 via a pivot bolt 68. Accordingly, responsive to rotation of the linkage drive shaft 60 (FIG. 15) via the drive motor 50, the drive linkage 42 pivots in a back-and-forth motion with respect to the pivot bolt 47 (FIG. 13) as the target actuator linkage 64 raises and lowers the target carriage 28 on the target post 23. A complete sequence of the positions of the drive linkage 42 and the target actuator linkage 64 as the target carriage 28 descends and then ascends the target post 23 is illustrated in FIGS. 10-13. At the uppermost position of the target carriage 28 on the target post 23, as illustrated in FIG. 10, both the drive linkage 42 and the target actuator linkage 64 of the target linkage assembly 38 may be deployed in a substantially center vertical position in the housing interior 8. As illustrated in FIG. 11, upon operation of the drive motor 50, the drive linkage 42 initially pivots to the right and simultaneously pulls the linkage attachment end 65 (FIG. 14) of the target actuator linkage 64 to the right as well. This action causes the carriage attachment end 66 of the target actuator linkage 64 to drop and pivot with respect to the target carriage 28, sliding the target carriage 28 to the lowermost position on the target post 23. Continued operation of the drive motor 50 causes both the drive linkage 42 and the target actuator linkage 64 to pivot from the right (FIG. 11) to the left, as illustrated in FIG. 12. Continued operation of the drive motor 50 causes the drive linkage 42 to again pivot from the left (FIG. 12) back to the center vertical position such that the linkage attachment end 65 of the target actuator linkage 64 slides the target carriage 28 back to the uppermost position on the target post 23, as illustrated in FIG. 13. The target linkage assembly 38 may have any structure with any number and type of linkage components to facilitate lowering and raising of the target carriage 28 on the target post 23 responsive to operation of the drive motor 50.

Figure 9:
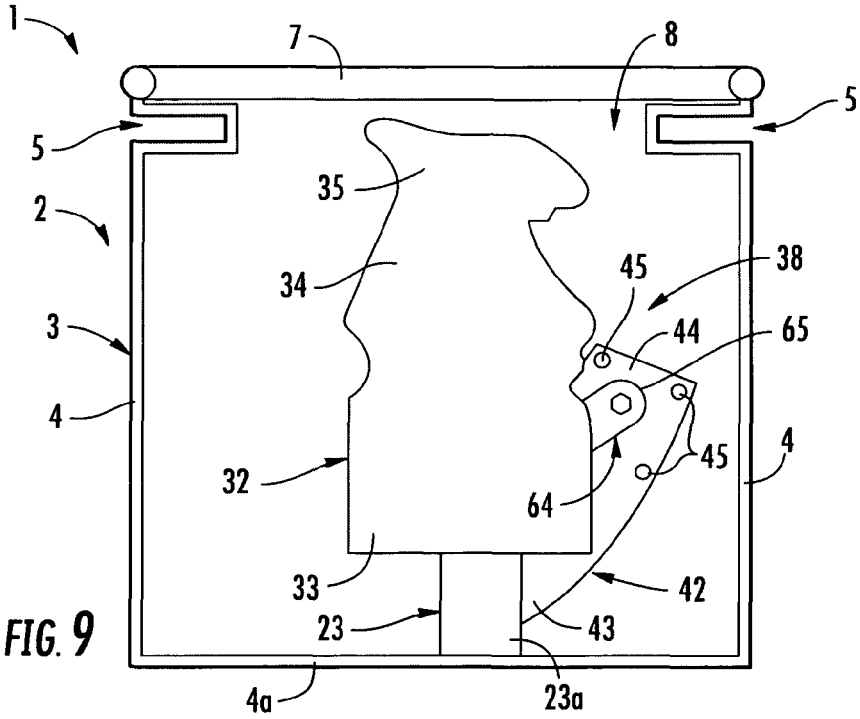
FIG. 9 is a front, partially schematic sectional view of an illustrative embodiment of the automated target assembly, with the target deployed in the internal or hidden position in the assembly housing of the assembly.

A target 32 is pivotally mounted on the target carriage 28 of the target actuator assembly 22. The target 32 may be wood, metal such as stainless steel and/or hard plastic such as a composite carbon fiber material or high density polypropylene (HDP), for example and without limitation. As illustrated in FIG. 9, the target 32 may be generally shaped to resemble the side profile of a rabbit, squirrel or other rodent or game animal. In some embodiments, the target 32 may be generally shaped in the side profile of an animal and may include a target base 33, a target body 34 extending from the target base 33 and a target head 35 extending from the target body 34. As illustrated in FIGS. 6-8, a switch activation flange 36 may extend from a lower edge of the target 32 for purposes which will be hereinafter described. The switch activation flange 36 may be disposed in generally perpendicular relationship with respect to the plane of the target 32.

The target 32 may be pivotally attached to the target carriage 28 according to any suitable technique which is known by those skilled in the art. As illustrated in FIGS. 6-8, in some embodiments a carriage flange 29 may extend from the target carriage 28. At least one target flange 37 may extend from the target 32. A pivot bolt 30 may extend through registering bolt openings (not illustrated) provided in the carriage flange 29 and the target flange or flanges 37. Accordingly, as illustrated in FIG. 8, the target 32 is capable of pivoting with respect to the plane of the target post 23 via the pivot bolt 30 for purposes which will be hereinafter described.

As illustrated in FIGS. 6-8, a target switch 78 which may be a pressure-type limit switch may be provided on the switch platform 18 in the housing interior 8. The target switch 78 may have an elongated, slotted switch adjustment bracket 79. A switch arm 80 may extend from the switch adjustment bracket 79. A switch roller 81 may be provided on the switch arm 80. As illustrated in FIGS. 6 and 7, the switch roller 81 of the target switch 78 may be disposed adjacent and in general proximity to the upper end 23*b* of the target post 23, within the path of the switch activation flange 36 on the target 32. The target switch 78 may be electrically connected to the main switch 74 via main switch wiring 75 (FIG. 16) and to the drive motor 50 through target switch wiring (FIG. 16). Accordingly, when the target 32 is disposed in the uppermost position on the target post 23 and the switch activation flange 36 on the target 32 engages the switch roller 81 of the target switch 78, as illustrated in FIG. 7, the target switch 78 senses the slightly raised or upwardly-biased position of the switch roller 81 and therefore, opens and terminates flow of electrical power from the battery 70 to the drive motor 50 via the main switch 74. Conversely, when the target 32 is pivoted with respect to the target carriage 28, as illustrated in FIG. 8, the switch activation flange 36 disengages the switch roller 81, causing the switch roller 81 to drop slightly. The target switch 78 senses the slightly dropped position of the switch roller 81 and therefore, closes and enables flow of electrical power from the battery 70 to the drive motor 50 via the main switch 74. This causes the drive motor 50 to first lower the target carriage 28 to the lowermost position on the target post 23 and the target 32 into the housing interior 8 and then raise the target carriage 28 back to the uppermost position on the target post 23 such that the target 32 again extends vertically from the housing interior 8, as illustrated in FIG. 7, as was heretofore described with respect to FIGS. 10-13. In some embodiments, the position of the switch roller 81 may be adjusted by sliding the switch arm 80 along the slotted switch adjustment bracket 79.

Figure 17:
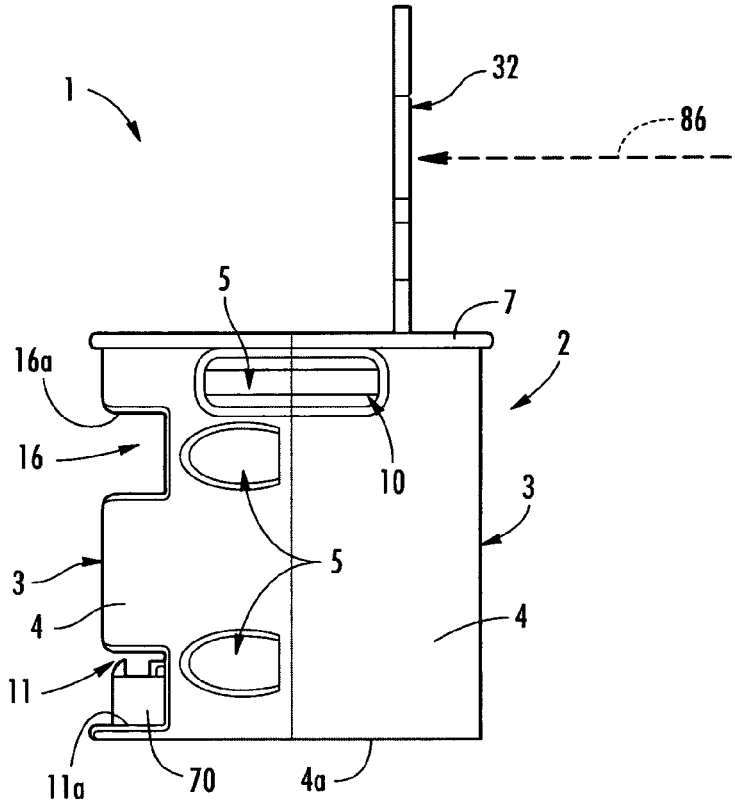
FIG. 17 is a side view of an illustrative embodiment of the automated target assembly, with the target deployed in an extended, pre-shoot position and a firearm-fired projectile (indicated by the dashed line) striking the target in exemplary application of the automated target assembly.
Figure 18:
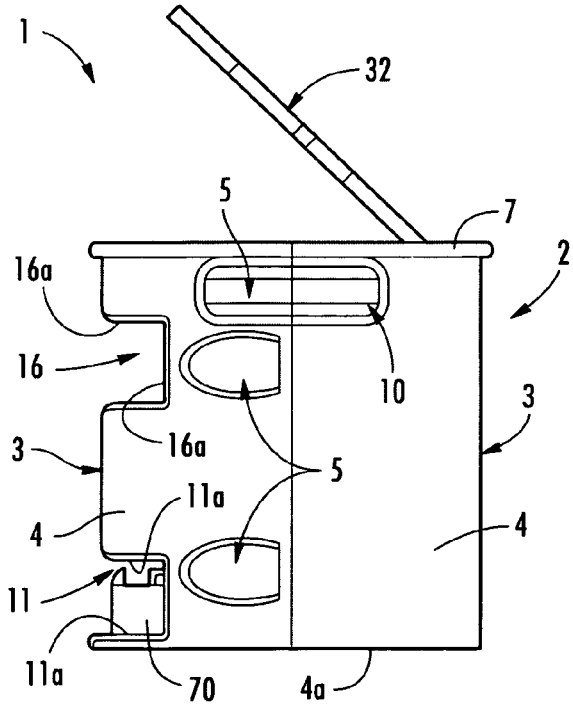
FIG. 18 is a side view of an illustrative embodiment of the automated target assembly, with the target deployed in a fallen position after being struck by the projectile.
Figure 19:
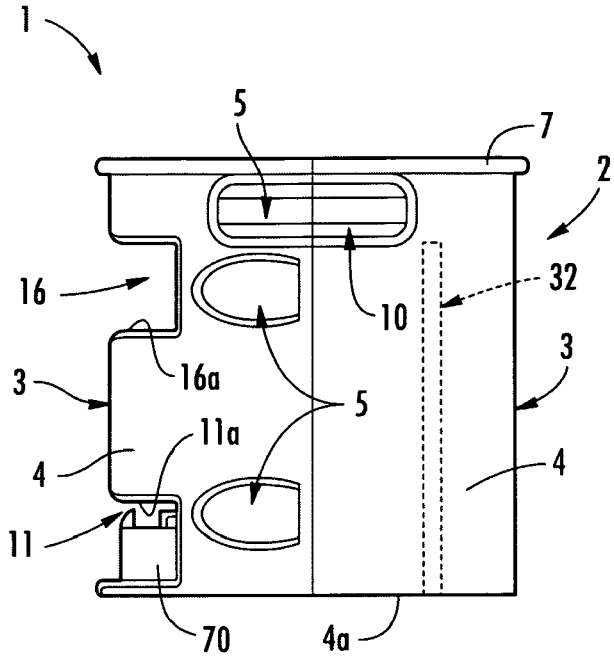
FIG. 19 is a side view of an illustrative embodiment of the automated target assembly, with the target (illustrated in phantom) deployed in the internal or hidden position in the assembly housing after being struck by the projectile preparatory to re-deployment of the target in the extended position for a second shooting attempt.
Figure 20:
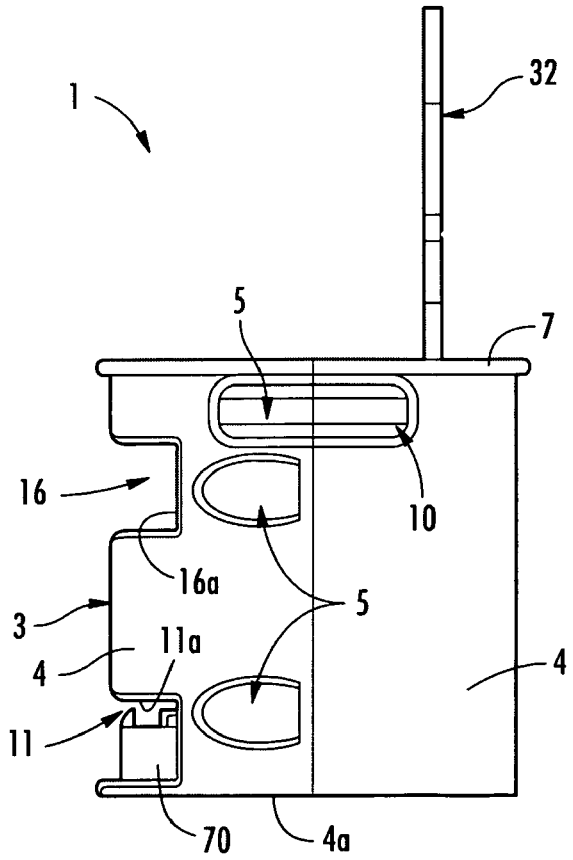
FIG. 20 is a side view of an illustrative embodiment of the automated target assembly, with the target deployed in the extended position preparatory to a second shooting attempt.

Referring next to FIGS. 6-8, 10-13 and 17-20 of the drawings, in exemplary application of the automated target assembly 1, the main switch 74 is manipulated to the "ON" position. This facilitates flow of electrical current from the battery 70 to the drive motor 50 via the closed main switch 74 and the closed target switch 78. Accordingly, the target linkage assembly 38 initially raises the target carriage 28 from the lowermost position of the target post 23 until the target carriage 28 reaches the uppermost position on the target post 23 and the target 32 extends from the assembly housing 2, as illustrated in FIGS. 7, 10 and 17. At that point, the switch activation flange 36 (FIG. 7) on the target 32 engages the switch roller 81 of the target switch 78, opening the target switch 78 which terminates further flow of electrical current from the battery 70 to the drive motor 50. A projectile 86 (FIG. 17) is then fired from a firearm (not illustrated) at a distance from the target 32 in an attempt to shoot the target 32 with the projectile 86. In the event that the projectile strikes the target 32, the momentum of the projectile 86 forces the target 32 rearwardly, as illustrated in FIGS. 8 and 18. Therefore, the switch activation flange 36 on the target 32 disengages the switch roller 81 of the target switch 78, as illustrated in FIG. 8, causing the switch roller 81 to drop slightly and closing the target switch 78. Thus, electrical current from the battery 70 flows through the closed main switch 74 and the closed target switch 78 to the drive motor 50. The drive motor 50 operates the target linkage assembly 38 as was heretofore described with respect to FIGS. 10 and 11 to facilitate movement of the target carriage 28 downwardly to the lowermost position on the target post 23 and lowering of the target 32 into the housing interior 8 of the assembly housing 2, as illustrated in FIGS. 6, 11 and 19. The drive motor 50 continues to operate the target linkage assembly 38 as was heretofore described with respect to FIGS. 12 and 13 to facilitate movement of the target carriage 28 upwardly back to the uppermost position on the target post 23 and extension of the target 32 from the assembly housing 2, as illustrated in FIGS. 7, 13 and 20. Accordingly, the switch activation flange 36 again engages and slightly raises the switch roller 81, opening the target switch 78 and terminating further operation of the drive motor 50 and movement of the target carriage 28 on the target post 23. Therefore, the target 32 is positioned for a second shooting attempt. Upon a second successful striking of the target 32 with a fired projectile 86, the cycle repeats.

While the preferred embodiments of the disclosure have been described above, it will be recognized and understood that various modifications can be made in the disclosure and the appended claims are intended to cover all such modifications which may fall within the spirit and scope of the embodiments of the disclosure.

What is claimed is:

1. An automated target assembly, comprising:
a target post;
a target carriage carried by the target post;
a target having a switch activation flange pivotally carried by the target carriage;
a target linkage assembly engaging the target carriage;
a power supply;
a drive motor connected to the power supply and drivingly engaging the target linkage assembly; and
a target switch connected to the power supply and the drive motor within a travel path of the switch activation flange;
wherein the target linkage assembly comprises a linkage flange, a drive linkage pivotally carried by the linkage flange with the drive motor carried by the drive linkage, and a target actuator linkage drivingly engaged by the drive motor and pivotally attached to the target carriage.

2. The automated target assembly of claim 1 further comprising a main switch connected to the power supply and the target switch.

3. The automated target assembly of claim 1 wherein the power supply comprises at least one battery.

4. The automated target assembly of claim 1 further comprising a linkage drive box carried by the drive linkage and wherein the drive motor is carried by the linkage drive box.

5. The automated target assembly of claim 4 further comprising a drive gear drivingly engaged by the drive motor and an idle gear drivingly engaged by the drive gear and drivingly engaging the target actuator linkage.

6. The automated target assembly of claim 1 wherein the target resembles an animal in profile.

7. An automated target assembly, comprising:
a target post;
a target carriage carried by the target post;
a target having a switch activation flange pivotally carried by the target carriage;
a target linkage assembly engaging the target carriage;
a power supply;
a drive motor connected to the power supply and drivingly engaging the target linkage assembly;
a target switch connected to the power supply and the drive motor within a travel path of the switch activation flange; and
a switch adjustment bracket carried by the target switch, a switch arm carried by the switch adjustment bracket and a switch roller carried by the switch arm and disposed within the travel path of the switch activation flange.

8. An automated target assembly, comprising:
an assembly housing having a housing bottom and a housing wall defining a housing interior;
a target post provided in the housing interior and having a lower end at the housing bottom and an upper end opposite the lower end;
a target carriage carried by the target post;
a target having a switch activation flange pivotally carried by the target carriage;
a target linkage assembly engaging the target carriage;
a power supply;
a drive motor connected to the power supply and drivingly engaging the target linkage assembly; and
a target switch connected to the power supply and the drive motor and disposed in general proximity to the upper end of the target post within a travel path of the switch activation flange;
wherein the target linkage assembly comprises a linkage flange, a drive linkage pivotally carried by the linkage flange with the drive motor carried by the drive linkage, and a target actuator linkage drivingly engaged by the drive motor and pivotally attached to the target carriage.

9. The automated target assembly of claim 8 further comprising a switch compartment provided in the housing interior and a main switch provided in the switch compartment and connected to the power supply and the target switch.

10. The automated target assembly of claim 8 further comprising a battery compartment provided in the housing interior and wherein the power supply comprises at least one battery provided in the battery compartment.

11. The automated target assembly of claim 8 further comprising a linkage drive box carried by the drive end of the drive linkage and wherein the drive motor is carried by the linkage drive box.

12. The automated target assembly of claim 11 further comprising a drive gear drivingly engaged by the drive motor and an idle gear drivingly engaged by the drive gear and drivingly engaging the target actuator linkage.

13. The automated target assembly of claim 8 wherein the target resembles an animal in profile.

14. An automated target assembly, comprising:
an assembly housing having a housing bottom and a housing wall defining a housing interior;
a target post provided in the housing interior and having a lower end at the housing bottom and an upper end opposite the lower end;
a target carriage carried by the target post;
a target having a switch activation flange pivotally carried by the target carriage;
a target linkage assembly engaging the target carriage;
a power supply;
a drive motor connected to the power supply and drivingly engaging the target linkage assembly;
a target switch connected to the power supply and the drive motor and disposed in general proximity to the upper end of the target post within a travel path of the switch activation flange; and
a switch adjustment bracket carried by the target switch, a switch arm carried by the switch adjustment bracket and a switch roller carried by the switch arm within the travel path of the switch activation flange.

15. An automated target assembly, comprising:
an assembly housing having a housing bottom and a housing wall defining a housing interior;
a battery compartment slot provided in the housing wall;

a battery compartment provided in the housing interior and communicating with the battery compartment slot;

a switch compartment slot provided in the housing wall;

a switch compartment provided in the housing interior and communicating with the switch compartment slot;

a switch platform carried by the housing wall in the housing interior;

a main switch connected to the battery and carried by the switch platform in the switch compartment;

a target post provided in the housing interior and having a lower end at the housing bottom and an upper end opposite the lower end;

a target carriage carried by the target post;

a target having a switch activation flange pivotally carried by the target carriage;

a target switch connected to the main switch and carried by the switch platform in general proximity to the upper end of the target post within a travel path of the switch activation flange;

a target linkage assembly engaging the target carriage; and a drive motor connected to the target switch and the battery and drivingly engaging the target linkage assembly.

16. The automated target assembly of claim 15 wherein the target linkage assembly comprises a linkage flange carried by the housing bottom, a drive linkage having a pivot end pivotally carried by the linkage flange and a drive end spaced-apart from the pivot end with the drive motor carried by the drive end of the drive linkage, and a target actuator linkage drivingly engaged by the drive motor and pivotally attached to the target carriage.

17. The automated target assembly of claim 16 further comprising a linkage drive box carried by the drive end of the drive linkage and wherein the drive motor is carried by the linkage drive box.

18. The automated target assembly of claim 17 further comprising a drive gear drivingly engaged by the drive motor and an idle gear drivingly engaged by the drive gear and drivingly engaging the target actuator linkage.

* * * * *